United States Patent [19]

Eheim

[11] 4,422,428

[45] Dec. 27, 1983

[54] FUEL INJECTION PUMP FOR INTERNAL COMBUSTION ENGINES

[75] Inventor: Franz Eheim, Stuttgart, Fed. Rep. of Germany

[73] Assignee: Robert Bosch GmbH, Stuttgart, Fed. Rep. of Germany

[21] Appl. No.: 46,285

[22] Filed: Jun. 7, 1979

[30] Foreign Application Priority Data

Sep. 7, 1978 [DE] Fed. Rep. of Germany ..... 2839014

[51] Int. Cl.[3] ..... F02M 59/20

[52] U.S. Cl. ..... 123/502; 123/501

[58] Field of Search ..... 123/139 AQ, 139 AP, 123/139 E, 501, 502

[56] References Cited

U.S. PATENT DOCUMENTS

| | | | |
|---|---|---|---|
| 3,797,469 | 3/1974 | Kobayashi et al. | 123/139 E |
| 3,897,764 | 8/1975 | Bakti | 123/139 AQ |
| 4,019,835 | 4/1977 | Skinner | 123/139 AQ |
| 4,108,130 | 8/1978 | Bailey | 123/139 AQ |

FOREIGN PATENT DOCUMENTS

| | | | |
|---|---|---|---|
| 2345724 | 9/1973 | Fed. Rep. of Germany | 123/139 AQ |
| 925979 | 5/1963 | United Kingdom | 123/139 AQ |
| 1238283 | 7/1971 | United Kingdom | 123/139 AQ |

*Primary Examiner*—Charles J. Myhre
*Assistant Examiner*—Magdalen Moy
*Attorney, Agent, or Firm*—Edwin E. Greigg

[57] ABSTRACT

An injection initiation adjuster for fuel injection pumps is proposed which includes a hydraulically actuated adjustment piston, whereby the actuation fluid is controllable via a control plunger disposed coaxially with the adjustment piston and this control plunger is electromagnetically adjustable.

5 Claims, 1 Drawing Figure

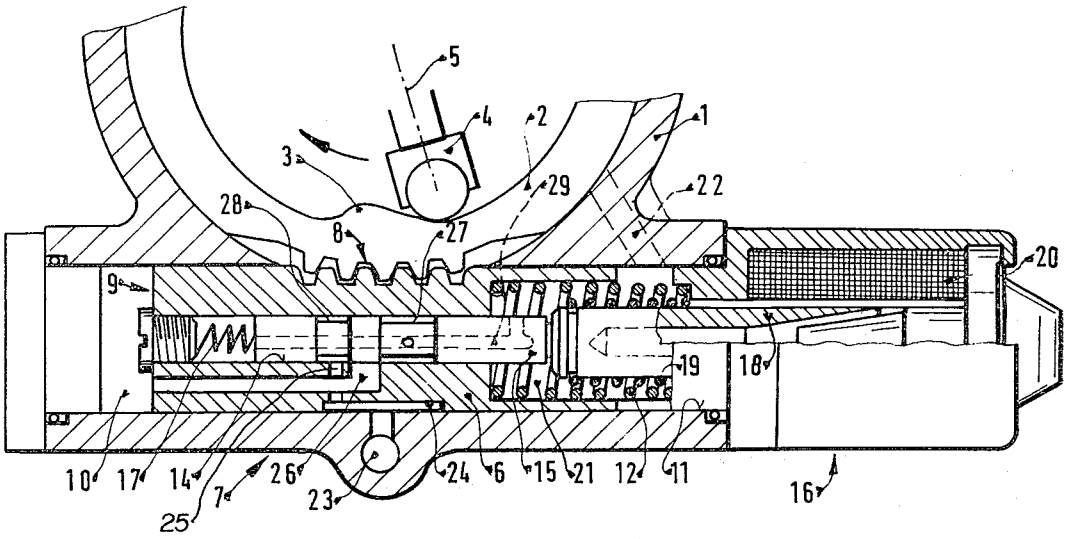
20
16
18
22
1
19
11
12
21
29
2
15
6
4
5
27
24
8
23
3
26
28
7
14
25
17
9
10

FUEL INJECTION PUMP FOR INTERNAL COMBUSTION ENGINES

BACKGROUND OF THE INVENTION

The invention relates to a fuel injection pump for internal combustion engines which is provided with a housing as well as a pressure operated adjusting piston correlated with a chamber in said housing and a remotely positioned axially disposed restoring spring arranged to cooperate with said piston. Also included therein are a control plunger disposed coaxially with said adjusting piston, first means on said control plunger arranged to cooperate with second means on said adjusting piston and thereby adapted to control fluid flow into and out of said pressure chamber, whereby the control plunger is displaceable relative to the adjusting piston against the force of a restoring spring.

As a result of the increasing requirements now being made for nontoxicity in exhaust gas, the engine manufacturers are increasingly demanding of the manufacturer of injection pumps a type of pump which will meet the increasing standards all of which present the manufacturer of the pumps with great difficulties, particularly because the pump must be economical to produce and a certain cost structure must not be exceeded. Thus, the engine manufacturer asks not only that the injection timing adjuster be adjusted in proportion to engine speed, and, if possible with a supplementary adjustment for starting speeds, but in addition that there be a pressure sequence in the injection timing adjusters which cannot be attained in known apparatuses.

OBJECT AND SUMMARY OF THE INVENTION

The fuel injection pump in accordance with the invention has the advantage over the prior art that any and every conceivable characteristic curve for the adjustment of the instant of injection is attainable at low cost and with a high level of functional reliability. Because nearly all injection pumps today have electric forward-control parts or electronic closed-loop control devices, it is very simple to integrate the forward control of the invention into the overall closed-loop control.

The invention will be better understood as well as further objects and advantages thereof become more apparent from the ensuing detailed description of a preferred embodiment taken in conjunction with the drawing.

BRIEF DESCRIPTION OF THE DRAWING

One fragmentary cross sectional view of an exemplary embodiment of the subject of the invention is shown in the drawing and will be described in detail below.

DESCRIPTION OF THE PREFERRED EMBODIMENT

Turning now to the drawing, only a partial section of the fuel injection pump is shown. Within a housing 1 thereof is supported a relatively rotatable but rigid cam ring 2, by means of the cams 3 of which a roller rod 4, radially extending pistons 5 of the injection pump are driven. Disposed tangentially to this cam ring 2 is an adjustment piston 6 of a device 7 which is arranged to adjust the initiation of injection, with the transfer of power between the adjustment piston 6 and the cam ring 2 taking place by way of a gear means 8. The first front face 9 of the adjustment piston 6 defines a pressure chamber 10 in the tangential bore 11 in the injection housing 1 which receives the piston 6. As a result of the pressure which prevails in the chamber 10, the adjustment piston 6 is actuated against a restoring spring 12.

The adjustment piston 6 is provided with a central bore 14 which is arranged to receive a control plunger or spool valve 15. The control plunger 15 is actuated by an electromagnet 16 against the force of a restoring spring 17 that is positioned adjacent to the front face 9 of the piston 6. The electromagnet 16 comprises a solenoid, the core 18 of which is pushed by a spring 19 out of the magnetic coil 20 in the direction of the control plunger 15. In this embodiment of the invention the spring 19 is constructed in a manner to be stiffer and thus to have more resistance to force than the spring 17, so that in order to readjust the magnetic forces, only the difference between the spring forces must be reduced in order to achieve an adjustment of the control plunger 15. The chamber 21 which encloses the springs 12 and 19 within the bore 11 is relieved of pressure via a relief bore 22. The pressure fluid, in particular Diesel fuel, to which the adjustment piston 6 is subjected, is delivered via a channel 23 in the housing 1. From the channel 23, the fuel proceeds into a groove 24 in the jacket surface of the adjustment piston and from there into a radial bore 25, which discharges into the central bore 14. The discharge point of a bore 26 which extends substantially axially in the servo-piston 6 is controlled by the control plunger 15 and also discharges at one end into the central bore 14, but at the other end terminates at the front face 9 and thus leads to the pressure chamber 10. The discharge points of the bores 25 and 26 into the central bore 14 are traversed by annular grooves 27 and 28 of the control plunger, whereby a connection between bore 25 and 26—that is, a connection between the pressure channel 23 and the pressure chamber 10—can be brought about by means of the annular groove 27. This connection always occurs when the control plunger 15 is displaced relative to the adjustment piston 6 against the force of spring 17. The annular groove 28, in contrast, is pressure-relieved toward the chamber 21 via a channel 29. Moreover, this annular groove 28 always arrives in an overlapping position with respect to the mouth of the bore 26 when the control plunger 15 is displaced by the spring 17 relative to the adjustment piston 6 as a result of the attraction of the electromagnet, and the pressure chamber 10 is thereby relieved An increase of the pressure in the pressure chamber 10 causes a displacement of the adjustment piston 6 against the force of the spring 12 and thus a displacement in the direction of earlier injection. The reverse is signified by a reduction in the pressure in the pressure chamber 10, that is, a displacement in the direction of later injection. Normally, the supply pressure is controlled in accordance with rpm, so that with increasing rpm, the displacement of the adjustment piston 6 thereby produces a displacement of the initiation of injection toward earlier injection. As a result of the use of the control plunger 15, the control of the instant of initiation of injection can be accomplished independently of the pressure and thus independently of the rpm as well. Depending on how the magnet 16 is actuated by an electric or electronic control device which is not shown, an adjustment of the initiation of injection takes place in the direction of later injection. Thus, for example, during a cold start of an engine, a different instant of injection can be selected from that during a warm start, which is of particular significance with respect to improving the exhaust gases.

In accordance with the invention, the electromagnet may also engage the control plunger via levers, or be embodied as a rotary magnet instead. The control plunger 15 may also be embodied as a rotary plunger.

The foregoing relates to a preferred embodiment of the invention, it being understood that other embodiments and variants thereof are possible within the spirit and scope of the invention, the latter being defined by the appended claims.

What is claimed and desired to be secured by Letters Patent of the United States is:

1. A fuel injection pump for internal combustion engines provided with a housing, a pressure operated adjusting piston correlated with a pressure chamber in said housing, a remotely positioned axially disposed piston restoring spring arranged to cooperate with said piston, a control plunger disposed coaxially with said adjusting piston, first means on said control plunger arranged to cooperate with second means on said adjusting piston and thereby adapted to control fluid flow into and out of said pressure chamber, whereby the control plunger is displaceable relative to the adjusting piston against the force of a control plunger restoring spring supported axially within said adjusting piston so that said control plunger is equalized in pressure via a longitudinal bore coaxial with said control plunger, further wherein said control plunger is adjustable by means of an electromagnet and a core relative thereto which directly engages one end of the control plunger via the force of a core spring which urges said core away from said electromagnet toward said control plunger.

2. A fuel injection pump in accordance with claim 1, further wherein said electromagnet further includes a solenoid which is disposed axially relative to said control plunger.

3. A fuel injection pump in accordance with claim 1, wherein said adjusting piston restoring spring is disposed in a pressure-relieved chamber and further wherein said core projects into a chamber relative to said control plunger which contains flowing fluid.

4. A fuel injection pump in accordance with claim 1, further wherein said bore in said adjusting piston within which said control plunger is arranged to reciprocate, and pressure fluid is permitted to flow in a controlled condition between said adjusting piston and said control plunger to said pressure chamber and from thence to a relief chamber.

5. A fuel injection pump in accordance with claim 1, further wherein said adjusting piston further includes a portion having gear teeth, said gear teeth arranged to cooperate with a toothed cam ring disposed in said housing, said cam ring engaging further piston means and arranged upon rotation to effect adjustment of the initiation of fuel injection.

* * * * *